US008279129B1

(12) United States Patent
Lewis et al.

(10) Patent No.: US 8,279,129 B1
(45) Date of Patent: Oct. 2, 2012

(54) TRANSVERSE DEVICE PHASE SHIFTER

(75) Inventors: Robert T. Lewis, Vista, CA (US); Ralston S. Robertson, Northridge, CA (US); William H. Henderson, Redondo Beach, CA (US)

(73) Assignee: Raytheon Company, Waltham, MA (US)

( * ) Notice: Subject to any disclaimer, the term of this patent is extended or adjusted under 35 U.S.C. 154(b) by 1319 days.

(21) Appl. No.: 12/004,852

(22) Filed: Dec. 21, 2007

(51) Int. Cl.
*H01Q 13/00* (2006.01)

(52) U.S. Cl. ..... 343/778; 343/772

(58) Field of Classification Search ..... 343/778, 343/772, 776, 826, 872
See application file for complete search history.

(56) References Cited

U.S. PATENT DOCUMENTS 6,157,347 A 12/2000 Robertson
6,999,040 B2 2/2006 Robertson, Jr. et al.
7,106,265 B2 9/2006 Robertson et al.
7,907,031 B2 * 3/2011 Kim et al. ..... 333/21 R
2002/0140089 A1 * 10/2002 Mimino et al. ..... 257/728
2004/0164915 A1 * 8/2004 Quan et al. ..... 343/754
2004/0257288 A1 12/2004 Robertson, Jr. et al.

* cited by examiner

*Primary Examiner* — Douglas W Owens
*Assistant Examiner* — Jennifer F Hu
(74) *Attorney, Agent, or Firm* — Christie, Parker & Hale, LLP

(57) ABSTRACT

A phase shifter operable at microwave or millimeter-wave frequencies includes a dielectric substrate with a bottom surface having a conductive ground plane layer and a conductive patterned layer formed on a top surface to define a conductor pattern. A series of active tuning elements is mounted on the top surface and cascaded along a propagation direction in a spaced arrangement along a longitudinal extent. A housing structure includes a bottom housing structure with a planar conductive bottom surface for contacting the ground plane layer, and a top housing structure fabricated with a channel which extend along the longitudinal extent and provide clearance for the active tuning elements. A bias circuit is connected to the respective series of active tuning elements.

22 Claims, 5 Drawing Sheets

TRANSVERSE DEVICE PHASE SHIFTER

This invention was made with Government support under Contract No. W911QX-04-C-0108 awarded by the Department of the Army. The Government has certain rights in this invention.

BACKGROUND

Ferrite materials are the common method for electronic phase shifter implementation. Ferrites are anisotropic, i.e., the phase shift of the energy in one direction is not replicated in the reverse direction. Ferrite phase shift is accomplished by applying a large current pulse, typically several amps in value, to the ferrite to establish a change in the large magnetic field and thereby adjusting the phase propagation characteristic of the material. Due to the hysteresis phenomena of ferrites, in order to change the phase another large current pulse is required to reset the phase to a stable reference phase state, followed by a second large pulse to establish the final phase state. The large current pulse requirements, as well as, the multiple pulses make the bias circuitry complex, costly and limited in speed. The phase shifters are also lossy. As the operating frequency increases, the size and coupling of such phase shifters to associated circuits is a major issue.

Another common method is to employ FET or PIN diode MMIC switches that switch in additional microstrip line lengths to realize a phase shifter. This additive line length provides the additional phase shift. Again, rather complex, external bias drive circuits are required to implement the switch bias. The PIN diode based systems require large levels of bias current, which further complicates the architecture. The individual switches are also lossy.

A more recent method is to employ voltage variable, dielectric material, like barium strontium titanate (BST). This material however, when employed in a phase shifter configuration requires ten thousand (10 Kv) volts of bias and is an extremely lossy medium for the propagation of RF energy.

SUMMARY OF THE DISCLOSURE

A phase shifter operable at microwave or millimeter-wave frequencies includes a dielectric substrate with a bottom surface having a conductive ground plane layer and a conductive patterned layer formed on a top surface to define a microstrip conductor pattern. A series of active tuning elements is mounted on the top surface and cascaded along a propagation direction in a spaced arrangement along a longitudinal extent. A housing structure includes a bottom housing structure with a planar conductive bottom surface for contacting the ground plane layer, and a top housing structure fabricated with a channel which extend along the longitudinal extent and provide clearance for the active tuning elements. A bias circuit is connected to the respective series of active tuning elements.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
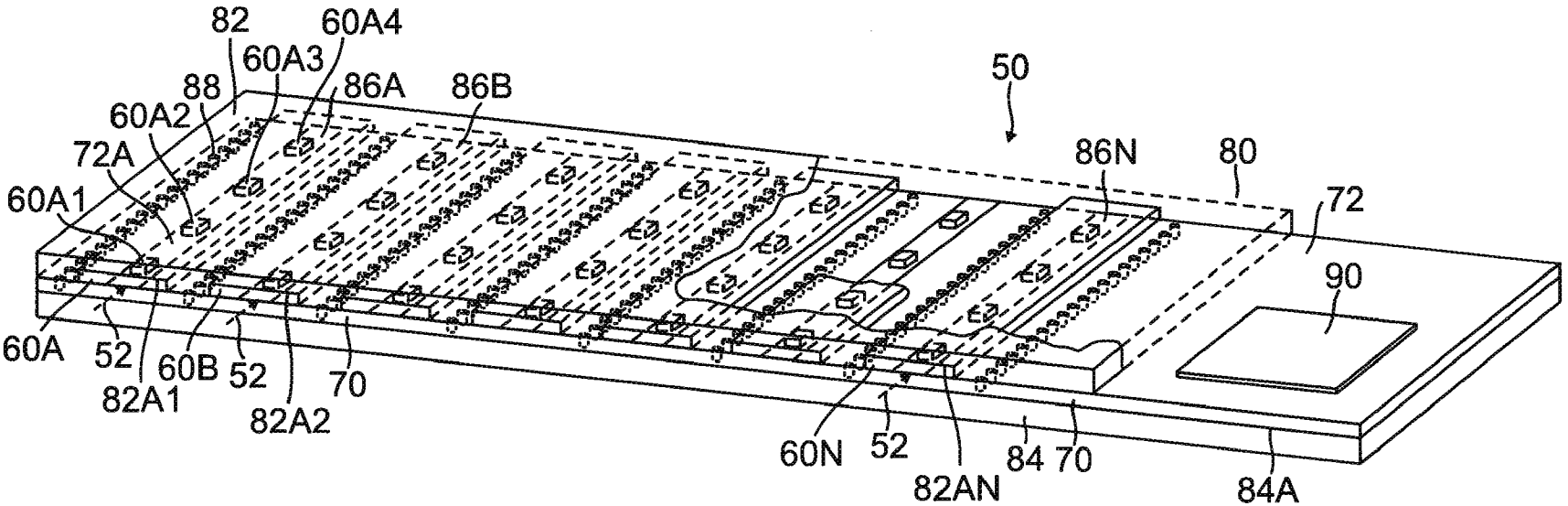
FIG. 1 depicts an exemplary embodiment of a phase shifter device array.

In the following detailed description and in the several figures of the drawing, like elements are identified with like reference numerals. The figures are not to scale, and relative feature sizes may be exaggerated for illustrative purposes.

FIG. 1 depicts an exemplary embodiment of a phase shifter device array 50 operable at microwave (or millimeter-wave), hereinafter sometimes referred to as a "Microstrip Transverse Device Array" ("MTDA"). The exemplary structure shown in FIG. 1 includes seven "boxed" microstrip phase shifters 60A, 60B . . . 60N, each with four tuning elements cascaded along the propagation direction. For example, phase shifter 60A includes tunable elements 60A1, 60A2, 60A3 and 60A4, arranged along the propagation direction indicated by arrow 52. The phase shifters employ discrete semiconductor devices, typically varactor diodes, (Schottkys, FETs, etc. may also be employed) as the tunable element. The discrete semiconductor devices are mounted on a dielectric substrate 70, e.g., a glass loaded Teflon™ material, quartz, Duroid™, or other dielectric material. From an RF performance view, dielectric constants in the range of 2 to 10 are preferred for some embodiments. This range provides a good compromise between the transmission line impedance and the physical size of the circuit. One exemplary embodiment may be fabricated on ceramic-loaded substrates with a 2.94 dielectric constant. This substrate provides a thermally stable material that allows the circuit traces to be defined using a laser ablation process. The tunable elements may be spaced from neighboring tunable elements by a spacing distance of one quarter of an operating wavelength, in an exemplary embodiment.

Figure 4:
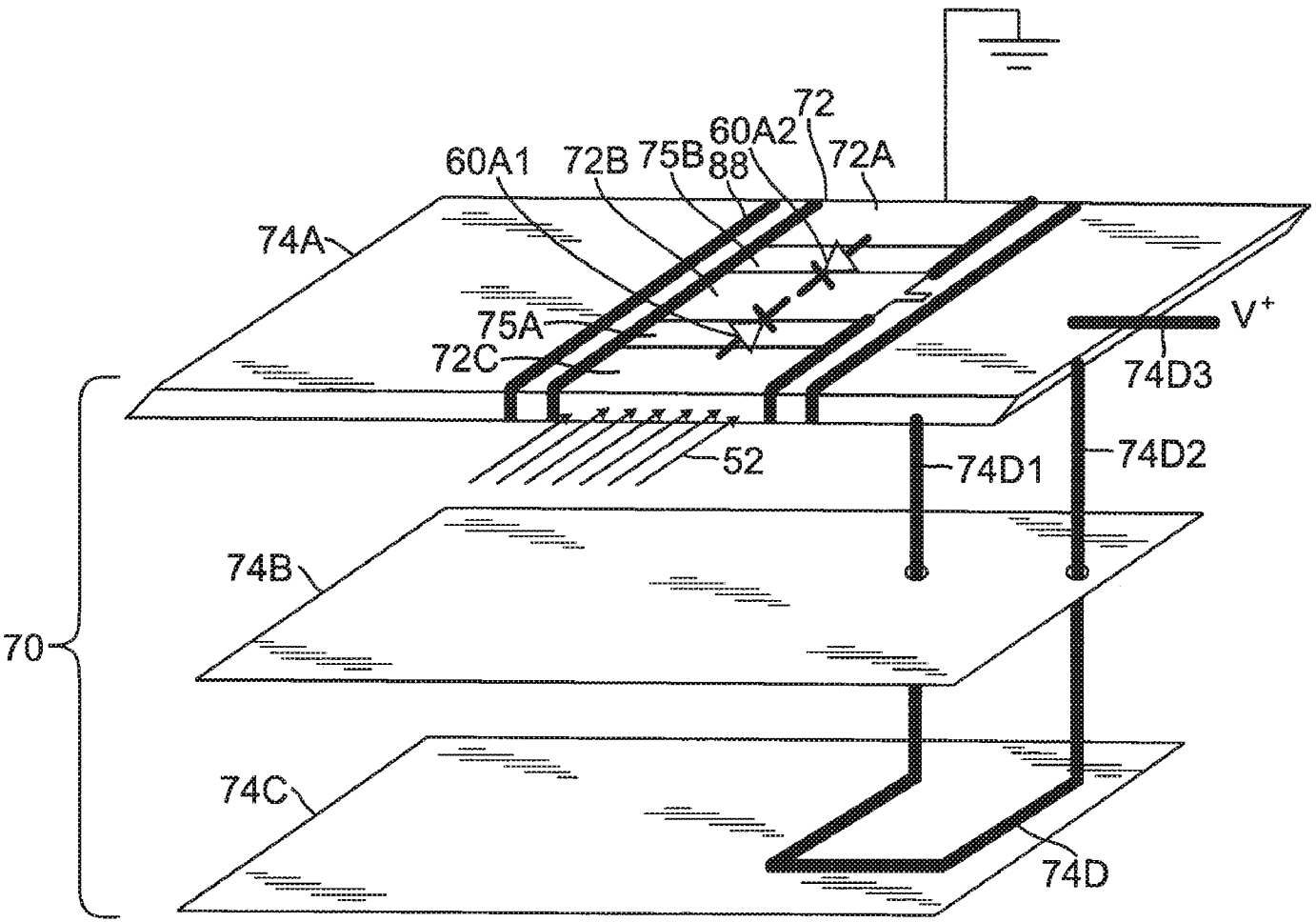
FIG. 4 diagrammatically illustrates an exemplary biasing arrangement.

The dielectric board 70 is plated on both sides with a metal layer, e.g. a copper layer. The top surface of the dielectric board is plated with metal layer 72, and the bottom surface is plated with a bottom metal layer, which is grounded, with both an RF and DC bias ground. In an exemplary embodiment, the metal layer 72 is patterned and then etched to realize the phase shifter circuit microstrip conductors, each of which has several cascaded metal contacts for the semiconductor devices. In an exemplary multilayer embodiment of the dielectric board 70, there may also be two other layers that are patterned and etched, dc bias distribution layers 74B and 74C (FIG. 4). An exemplary microstrip conductor region 72A is generally shown in FIG. 1. The semiconductor devices are bonded at each circuit junction to obtain electrical contact. The semiconductor devices or tunable elements are mounted so that each bridges a gap between microstrip conductor traces, and constitute series elements in an equivalent circuit of the structure. In an exemplary embodiment, each phase shifter has an array of series mounted tunable elements (four in the example illustrated in FIG. 1), and so the device may be referred to as a microstrip transverse device array (MTDA) phase shifter. The phase shifter can be implemented in various types of transmission line media, e.g., microstrip, stripline, suspended stripline, dielectric loaded waveguide and coplanar waveguide (CPW), and may be more generally referred to as a transverse device array (TDA) phase shifter.

The dielectric board 70 is housed between two metal plates 82, 84 which provide a housing structure 80. The top plate 82 is fabricated with cavities or relieved areas 82A1, 82A2 . . . 82AN which run the length of each phase shifter 60A, 60B, 60C . . . 60N. The cavities 82A1, 82A2 . . . 82AN provide clearance for the semiconductor devices, and isolation between adjacent phase shifter circuits. In an exemplary embodiment, each channel may have a width which is one half an operating wavelength. The channel height and dielectric constant of the substrate may be chosen in concert to provide the required impedance while providing adequate relief for the diodes mounted on the dielectric board. In an exemplary embodiment, the height of the channel is 0.02 inch. Practically a channel height of 0.02" may be a minimum to insure clearance for the diodes, and a height of a quarter wavelength may ensure the element spacing in an orthogonal plane will support wide angle scanning without the appearance of grating lobes in the antenna pattern, in an exemplary embodiment. The bottom plate may have a planar dielectric-board-facing surface 84A, which is in electrical contact with the lower metal layer formed on the lower surface of the dielectric substrate. This may serve as a ground plane surface. The dielectric board 70 and housing structure 80 form an array of boxed microstrip transmission lines 86A, 86B . . . 86N. Rows of plated via holes 88 extending through the dielectric board prevent coupling between adjacent phase shifters.

Figure 2:
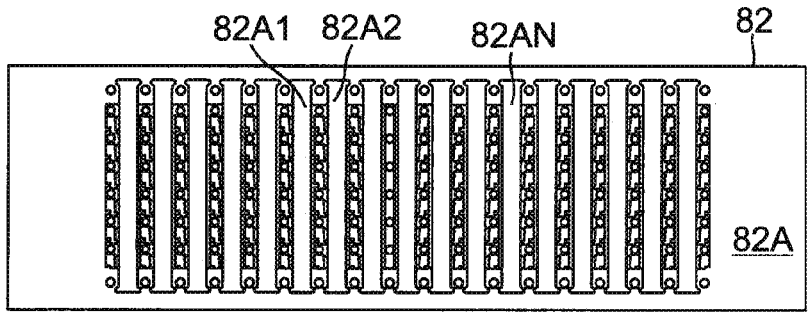
FIG. 2 is a plan view of an exemplary embodiment of a top housing plate for a phase shifter device array.
Figure 3:
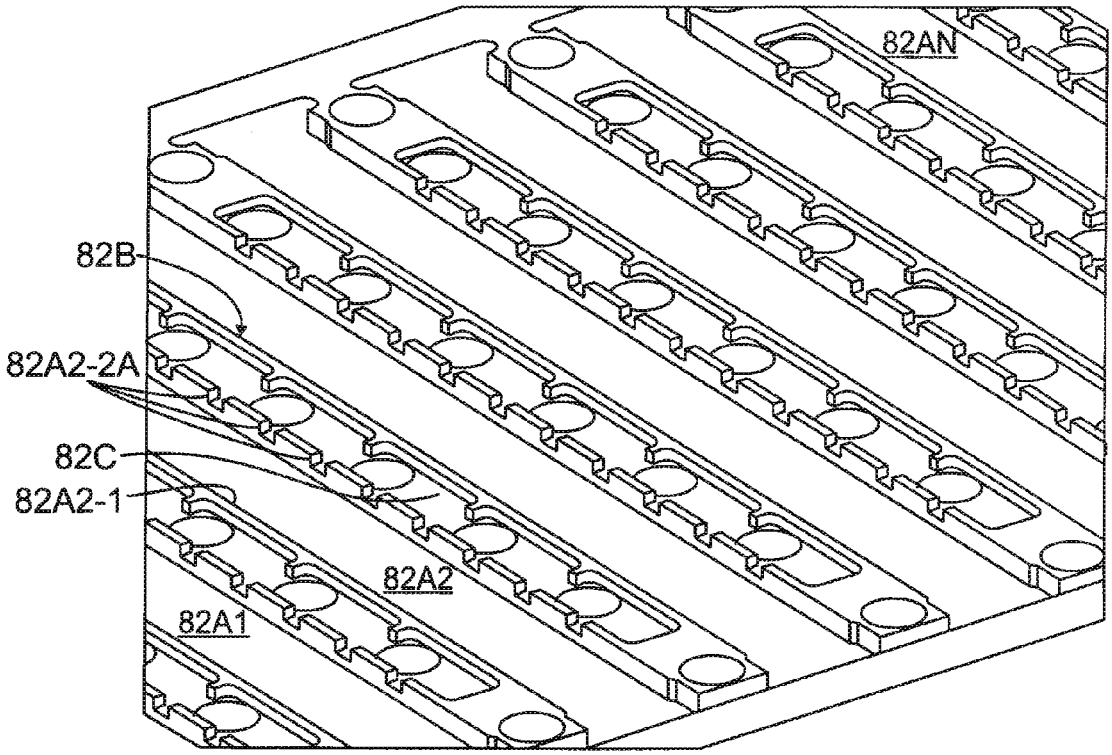
FIG. 3 is an enlarged view of a fragment of the housing plate of FIG. 2.

FIGS. 2 and 3 illustrate an exemplary embodiment of an upper housing plate 82 which may form part of a housing structure for a phase shifter array. The exemplary embodiment of the housing plate 82 depicted in FIG. 2 has a plurality of recessed channels including channels 82A1, 82A2 . . . 82AN similar to those depicted in FIG. 1, and these channels partially "box" each phase shifter circuit, while providing clearance for the phase shifter tunable elements and the microstrip conductor lines of the phase shifter circuits. The embodiment of the housing plate 82 depicted in FIG. 2 is adapted to provide channels for a greater number of phase shifter circuits than the number depicted in the exemplary embodiment of FIG. 1. The phase shifter may also have utility when fabricated as a single phase shifter, as opposed to an array of phase shifters. As a single phase shifter it has utility for a variety of applications; e.g: due to the high speed phase response, it can function as a pseudo true time delay unit for antenna subarrays for antenna beam stabilization during wideband beam scanning. Each channel is bounded on its longitudinal sides by channel sidewalls such as sidewalls 82A2-1 and 82A2-2. While one sidewall may be adapted to continuously contact the dielectric substrate surface, the other sidewall may have a plurality of spaced gaps such as gaps 82A2-2A formed along its bottom surface. The gaps allow bias lines to run to the tunable elements under the sidewall without being shorted to ground by contact with the housing 82. Thus, each channel defined in the housing structure 82 may be separated by ribs 82B which may have open channels or areas 82C formed therein. These open areas may provide space for tunable element biasing circuitry defined by the patterned metal layer on the upper surface of the dielectric layer 70 (FIG. 1).

FIG. 1 illustrates an exemplary MTDA 50 with seven individual microstrip phase shifters 60A. 60B . . . 60N, each of which includes four cascaded tunable elements 60A1, 60A2, 60A3 and 60A4. The dielectric board 70 may be a single dielectric layer on which is etched microstrip circuit features. Alternatively, additional dielectric layers may be added in the dielectric board 70 in order to facilitate the realization of a DC bias network that distributes control signals from an electronic controller 90 (FIG. 1), e.g. an ASIC, to the individual phase shifters circuits. FIG. 4 diagrammatically illustrates an exemplary biasing arrangement. In the exemplary embodiment illustrated in FIG. 4, the dielectric board 70 is a multilayer structure including a dielectric RF layer 74A, which may be fabricated of a dielectric material such as 6002 Duroid™. The multilayer board 70 further includes a DC isolation layer 74B and a DC bias distribution layer 74C. In one exemplary embodiment, the layers 74B and 74C may be constructed using an FR4-B stage pre-preg material, although other materials may alternatively be employed.

The plated through holes 88 are formed through the layer 74A, and the patterned metal layer 72 is formed on the top surface of the layer 74A. The layer 72 is patterned into several isolated conductor regions for each phase shifter microstrip conductor, including conductor regions 72A, 72B and 72C. It is to be understood that FIG. 4 diagrammatically illustrates only a fragment of the phase shifter 60A, and its biasing arrangement. The adjacent conductor regions are spaced apart to form gaps or junctions such as 75A, 75B.

The semiconductor tuning elements, e.g. flip-chip varactor diodes 60A1 and 60A2, are mounted on the layer 74A, to bridge gaps in the microstrip conductor traces, e.g. gaps 75A, 75B. In the exemplary fragment shown in FIG. 4, conductor regions or traces 72A and 72C form part of the layer 72 connected to ground, and conductor region 72B is isolated from ground. Conductor region 72B is connected to a DC bias voltage source V+ by DC bias conductors including conductor 74D, which is defined by a conductor layer pattern formed on the dielectric layer 74C, with DC conductor portions 74D1, 74D2 defined by plated through vias in the layer 74B. DC conductor portion 74D1 makes contact with conductor region 72B of the metal layer 72, to apply a bias voltage to conductor region 72B and thus reverse bias the diodes 60A1, 60A2. DC conductor portion 74D2 is passed through vias in the layers 74B, 74A and connects to DC conductor 74D3 which is connected to a bias voltage source V+.

The phase shifters of the array 50 may be fed with microwave/millimeter wave energy by various feed arrangements. For example, a feed may be a reduced height waveguide, with the height of the waveguide the same as the thickness of the dielectric layer 50 (FIG. 1). In one exemplary embodiment, the reduced height waveguide may have a height of 0.015 inch and a width of 3 inches, to feed the entire array. The microwave/millimeter wave energy from the feed enters the phase shifter array through the edge of the dielectric layer 70 carrying the tunable elements, undergoes a mode transformation, and propagates along the phase shifter array to the output side. The mode transformation is from a parallel plate waveguide mode, the input signal to the phase shifter array, to an array of individual and electrically isolated phase shifters. On the output side of the phase shifter, the process occurs in reverse. The mode transformation is in essence a N-Port distribution network; the input is a single signal parallel plate transmission line that is divided into the array of discrete signal microstrip phase shifter transmission lines. The phase shifter array modulates the relative phase of the signals within the separate phase shifters, and then preserves the relative phasing as the signals are now combined back into single signal parallel plate transmission line.

When a voltage bias is applied so as to reverse bias the diode junction, a depletion region is formed. It is known that the width of a varactor's depletion region acts to mimic the separation distance between the two charged parallel metal plates of a capacitor. As the (reverse) bias is increased, the depletion region enlarges, resulting in a reduction in both the capacitance and the epitaxial series resistance. The microwave/millimeter-wave energy within the waveguide is coupled to the diodes via the MTDA circuit. "Waveguide" here refers to an individual element of the phase shifter array. The waveguide is the region bounded by the boxed region defined by the air cavity and the conductive sidewall vias and the microstrip ground plane on the bottom. Changing the capacitance of the diodes causes a change in the phase of the signal. In an exemplary embodiment, the phase shifter architecture may be implemented using readily available and low cost materials, and the MTDA phase shifters in such a case may be relatively inexpensive compared to other phase shifter implementation methods. Further, since the diodes are operated in a reverse biased and low voltage condition, e.g. with a reverse bias of 20 volts, the current required to change the phase shifter and operate the unit is negligible. The subsequent power draw is negligible and substantially simplifies the necessary bias electronics. Phase shift operations may take place at very high speeds, e.g., in some embodiments on the order of 10 nanoseconds or less.

Exemplary embodiments of the phase shifter circuit may be used as the phase shifting element or elements in a number of different antenna architectures. Exemplary embodiments may be used to for electronic beam steering in both the E-plane and H-plane for a number of different antenna architectures.

Figure 5:
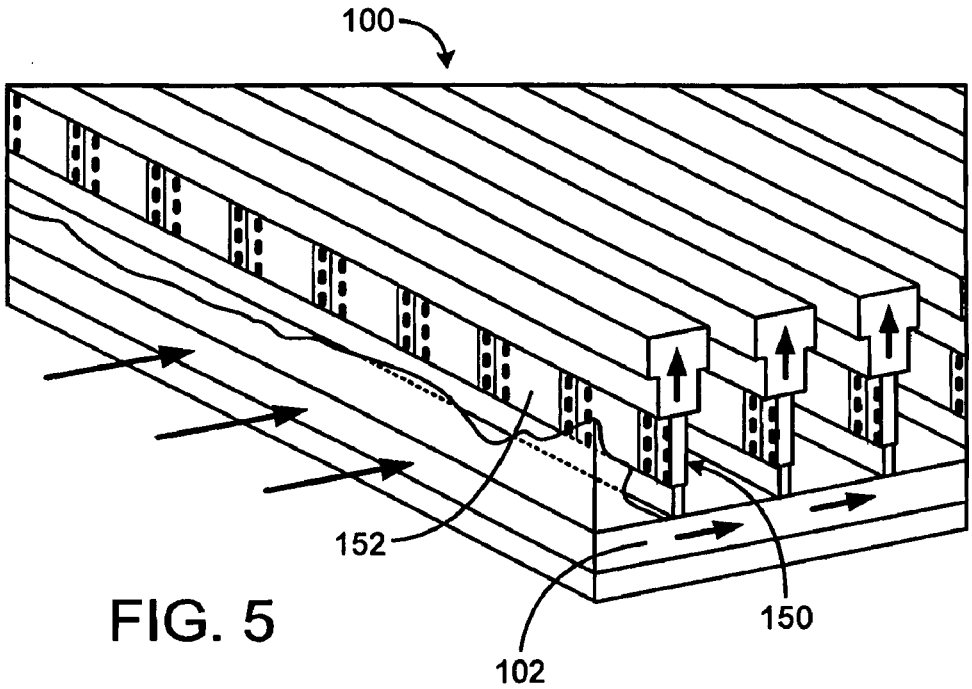
FIG. 5 is a schematic illustration of an exemplary embodiment of a traveling wave continuous transverse stub antenna (CTS) employing phase shifter device arrays inside CTS stubs.
Figure 5A:
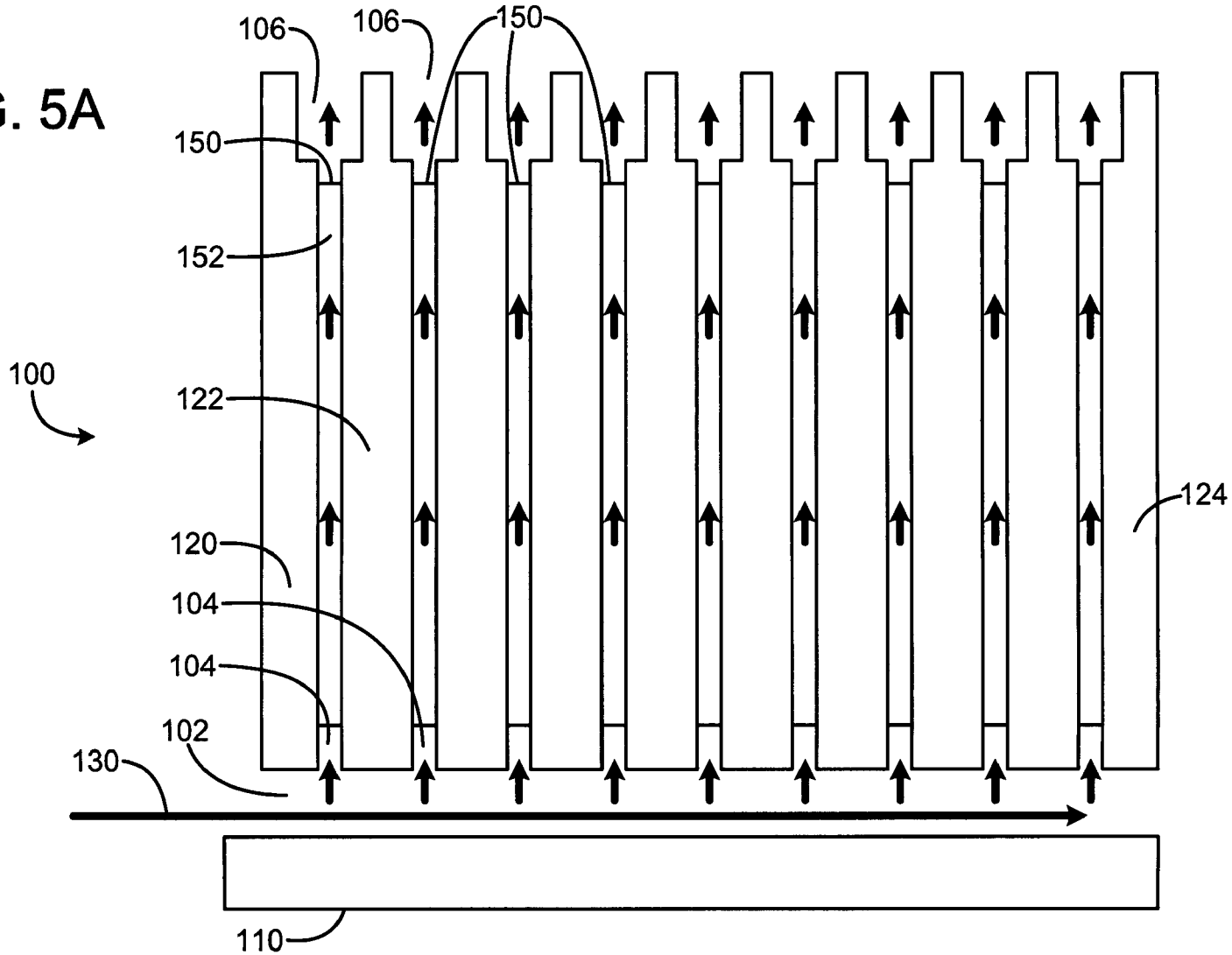
FIG. 5A is a diagrammatic side cross-sectional view of a CTS array with phase shifter device arrays.

One exemplary antenna architecture is a traveling wave continuous transverse stub antenna (CTS). An exemplary embodiment is illustrated in a simplified diagrammatic form in FIGS. 5 and 5A. This exemplary embodiment is a traveling wave antenna 100 including a dielectric-filled overmoded waveguide (quasi-parallel plate) 102 defined by a ground plane 110 and housing plates 120, 122. The waveguide 102 is periodically interrupted by E-plane TEE junctions 104, which couple energy to the stub radiators 106. The structure may be fed by a linefeed 130, which can be one of many possible forms, e.g., waveguide taper, power divider network, and T/R module array. In the MTDA antenna architecture, the CTS structure may be used as a feed for the phase shifter arrays 150. In this exemplary embodiment, the MTDAs 150 are placed inside the CTS stub radiators 106. The MTDAs may be implemented as an alternating stack of printed wiring boards (PWBs) 152 and the aluminum housings 120, 122. Each PWB 152 forms one diode array, and is sandwiched between two housings which contain the air cavities that provide relief for the diodes of the array 150. Two aluminum housings and one PWB form a single phase shifter array. The housings also provide clearance and tapped holes to allow the sandwiched structure to be assembled together. The MTDA stack thus includes multiple PWBs assembled into a phase shifter subassembly. The MTDA subassembly includes the mode transformers that allow coupling between the parallel plate feed and the phase shifter arrays. This phase shifter subassembly can be fastened together with screws, tie rods or other fasteners. The phase shifter subassembly is then integrated with the CTS feed. The registration between the phase shifter subassembly and the CTS feeds insures that each CTS stub serves as a feeding point for exactly one of the diode arrays comprising the subassembly.

Another exemplary antenna architecture is a true time delay (corporate feed) CTS antenna. This is essentially the same as the architecture depicted in FIG. 5, but with a corporate feed comprising E-plane parallel plate Tee's.

Figure 6:
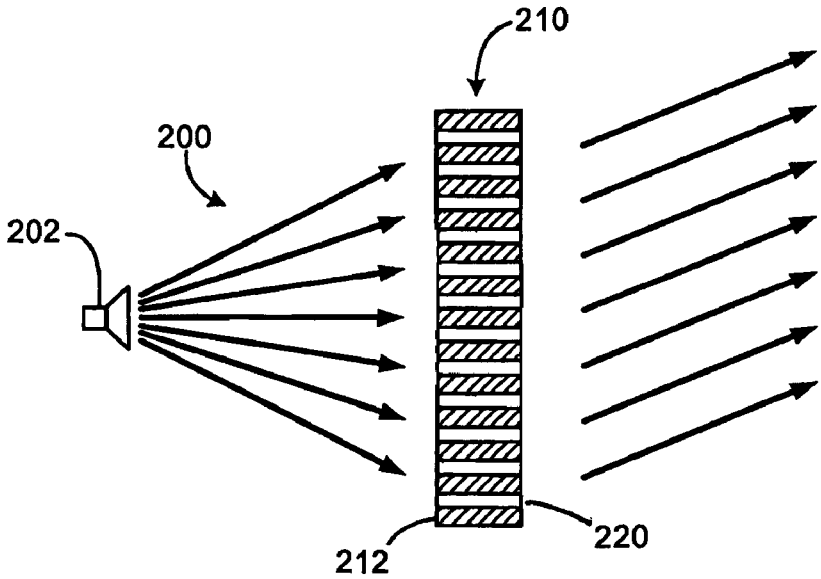
FIG. 6 illustrates an exemplary lens configuration, with a free space feed for a set of phase shifter device arrays in a stacked arrangement.

A further exemplary antenna architecture is a lens antenna configuration, with an arbitrary fixed beam antenna acting as a free space feed for a set of MTDAs stacked together to form a two dimensional (2D) array of waveguide phase shifters. An exemplary embodiment of a lens antenna 200 employing MTDAs is shown in FIG. 6. The antenna includes a fixed beam antenna 202 which acts as the free space feed for lens 210. The lens 210 is an alternating stack of metal housings 212 and MTDA circuit board structures 220. The structures 220 may be similar to the array structure 50 depicted in FIG. 1, for example. The phase shifter subassembly or lens 210 forms the basic ESA unit, in which the beam steering occurs. The feeding of the subassembly can utilize a space feed as in a lens application or a closed transmission line feed as when the phase shifter subassembly is excited by a CTS feed.

All of these antenna architectures employ many MTDAs which together create a two dimensional array of boxed microstrip phase shifters. Since all of the phase shifters can be individually controlled, any desired aperture phase distribution can be realized and therefore electronic beam steering over a full hemisphere can be achieved.

In an exemplary embodiment, the phase shifter may be fabricated on a single circuit board, rather than multiple circuit boards separated by dielectric spacers. The boxed microstrip configuration eliminates unwanted parasitic circuit elements associated with rectangular waveguide implementations, and does not require the use of thin dielectric coatings.

The MTDA phase shifter, in an exemplary embodiment, is reciprocal in operation, in that the phase shift is the same in the forward and reverse direction.

Exemplary operation frequencies of an MTDA include both microwave and millimeter-wave frequencies. One exemplary operating band is a Ka-band.

Although the foregoing has been a description and illustration of specific embodiments of the invention, various modifications and changes thereto can be made by persons skilled in the art without departing from the scope and spirit of the invention as defined by the following claims.

What is claimed is:

1. A transverse device array phase shifter operable at microwave or millimeter-wave frequencies, comprising:

a dielectric substrate having a top surface and a bottom surface, the bottom surface having a conductive ground plane layer formed thereon, the top surface having a conductive patterned layer formed thereon to define a conductor pattern;

an array of active tuning elements cascaded along a propagation direction in a spaced arrangement along a longitudinal extent;

a housing structure including a bottom housing structure with a planar conductive bottom surface for contacting the bottom conductive layer on the bottom surface of the dielectric substrate, and a top housing structure fabricated with a channel which extends along the propagation direction in the longitudinal extent and provides clearance for the active tuning elements; and a bias circuit connected to the array of active tuning elements, wherein the propagation direction is a direction of a traveling electromagnetic wave.

2. The phase shifter of claim 1, wherein said channel has a width which is one half an operating wavelength.

3. The phase shifter of claim 1, wherein the active tuning elements each comprise a semiconductor junction.

4. The phase shifter of claim 1, wherein the active tuning elements each comprise a voltage variable capacitance element.

5. The phase shifter of claim 1, wherein each of said active tuning elements comprises a varactor diode.

6. The phase shifter of claim 1, wherein the series of active tunable elements are mounted so that each bridges a gap between conductor traces comprising said conductor pattern.

7. The phase shifter of claim 1, wherein the series of tunable elements are spaced apart by a spacing distance of one quarter of an operating wavelength.

8. The phase shifter of claim 1, wherein the bias circuit includes a DC voltage source, the dielectric substrate is a multilayer substrate, and wherein the biasing circuit includes a buried conductor trace portion and a bias conductor passing through a layer of said multilayer substrate.

9. The phase shifter of claim 1, further comprising:

first and second series of conductive vias extending through the dielectric substrate and extending on opposite sides of the series of active tuning elements along the longitudinal extent.

10. The phase shifter of claim 1, wherein said phase shifter is adapted for operation at Ka band frequencies.

11. The phase shifter of claim 1, wherein said channel is bounded on its longitudinal sides by a first channel sidewall and a second channel sidewall, wherein, the first channel sidewall continuously contacts the dielectric substrate surface, the second channel sidewall has a plurality of spaced gaps formed along its bottom surface, and the gaps allow the bias circuit to connect to the array of active tuning elements without being shorted to ground by contract with the housing structure.

12. A phase shifter array operable at microwave or millimeter-wave frequencies, comprising:

a dielectric substrate having a top surface and a bottom surface, the bottom surface having a conductive ground plane layer formed thereon, the top surface having a conductive patterned layer formed thereon to define a plurality of microstrip conductor patterns;

a plurality of series of active tuning elements, each series cascaded along a propagation direction in a spaced arrangement along a longitudinal extent;

first and second series of conductive vias extending through the dielectric substrate and extending on opposite sides of each series of active tuning elements along the longitudinal extent;

a housing structure including a bottom housing structure with a planar conductive bottom surface for contacting the bottom conductive layer on the bottom surface of the dielectric substrate, and a top housing structure fabricated with a plurality of channels which extend along the propagation direction in the longitudinal extent and provide clearance for the active tuning elements; and a bias circuit connected to the active tuning elements in each series of active tuning elements, wherein the propagation direction is a direction of a traveling electromagnetic wave.

13. The array of claim 12, wherein each channel has a width which is one half an operating wavelength.

14. The array of claim 12, wherein the active tuning elements each comprise a semiconductor junction.

15. The array of claim 12, wherein the active tuning elements each comprise a voltage variable capacitance element.

16. The array of claim 12, wherein each of said active tuning elements comprises a varactor diode.

17. The array of claim 12, wherein the active tunable elements in each series of tunable active elements are mounted so that each bridges a gap between microstrip conductor traces comprising one of said plurality of microstrip conductor patterns.

18. The array of claim 12, wherein the series of tunable elements are spaced apart by a spacing distance of one quarter of an operating wavelength.

19. The array of claim 12, wherein said array is adapted for operation at Ka band frequencies.

20. A continuous transverse stub (CTS) array including a series of CTS radiator structures, and wherein a phase shifter array as recited in claim 12 is positioned in each of said CTS radiator structures.

21. A lens antenna, including a fixed beam antenna serving as a free space feed for a lens, and wherein the lens comprises a plurality of phase shifter arrays as recited in claim 12, said plurality of phase shifter arrays arranged in a stacked configuration to form a two dimensional array of phase shifters.

22. The array of claim 12, wherein each channel is bounded on its longitudinal sides by a first channel sidewall and a second channel sidewall, wherein each first channel sidewall continuously contacts the dielectric substrate surface, each second channel sidewall has a plurality of spaced gaps formed along its bottom surface, the gaps allow the bias circuit to connect to the array of active tuning elements without being shorted to ground by contract with the housing structure, and each channel defined in the housing structure may be separated by ribs which may have open channels.

* * * * *